US006729788B2

(12) United States Patent
Bouveresse

(10) Patent No.: US 6,729,788 B2
(45) Date of Patent: May 4, 2004

(54) HAND-HELD DISPENSER FOR APPLYING A FLOWABLE CORRECTION MEDIUM ON A SUBSTRATE SURFACE

(75) Inventor: Jeanne-Antide Bouveresse, Rueil Malmaison (FR)

(73) Assignees: BIC Deutschland GmbH & Co. (DE); Societe BIC (FR)

( * ) Notice: Subject to any disclaimer, the term of this patent is extended or adjusted under 35 U.S.C. 154(b) by 0 days.

(21) Appl. No.: 10/226,238

(22) Filed: Aug. 23, 2002

(65) Prior Publication Data

US 2003/0031500 A1 Feb. 13, 2003

Related U.S. Application Data

(63) Continuation of application No. PCT/EP01/01531, filed on Feb. 12, 2001.

(30) Foreign Application Priority Data

Feb. 25, 2000 (EP) ..... 00103992

(51) Int. Cl.[7] ..... B43M 11/02

(52) U.S. Cl. ..... 401/220; 401/219; 401/208

(58) Field of Search ..... 401/220, 219, 401/218, 208, 199, 198, 205

(56) References Cited

U.S. PATENT DOCUMENTS

| | | | | | |
|---|---|---|---|---|---|
| 3,917,419 | A | | 11/1975 | Kumakura et al. | 401/218 |
| 4,511,273 | A | | 4/1985 | Trotta | 401/260 |
| 4,572,691 | A | | 2/1986 | Kirchhoff et al. | 401/214 |
| 4,685,820 | A | | 8/1987 | Kremer et al. | 401/260 |
| 4,723,860 | A | * | 2/1988 | Giblin et al. | 401/208 |
| 4,812,071 | A | | 3/1989 | Batra et al. | 401/264 |
| 4,813,463 | A | | 3/1989 | Lin | 141/351 |
| 4,917,521 | A | | 4/1990 | Lai | 401/260 |
| 4,923,317 | A | | 5/1990 | Bishop et al. | 401/205 |
| 5,056,949 | A | | 10/1991 | Petrillo | 401/214 |
| 5,109,798 | A | * | 5/1992 | Impastato | 401/218 |
| 5,123,766 | A | | 6/1992 | Babiak | 401/180 |
| 5,261,755 | A | | 11/1993 | Draper et al. | 401/264 |
| 5,401,113 | A | * | 3/1995 | Gueret | 401/208 |
| 5,480,250 | A | * | 1/1996 | Birden | 401/198 |
| 5,482,393 | A | | 1/1996 | Sekiguchi et al. | 401/214 |
| 5,499,881 | A | | 3/1996 | Chang | 401/17 |
| 5,516,223 | A | | 5/1996 | Matz et al. | 401/260 |
| 5,716,151 | A | | 2/1998 | Satake | 401/188 A |
| 5,888,007 | A | | 3/1999 | Nicoll et al. | 401/206 |
| 5,897,264 | A | | 4/1999 | Baudino | 401/199 |
| 5,971,648 | A | | 10/1999 | Koreska | 401/260 |
| 6,004,057 | A | | 12/1999 | Fulop | 401/195 |
| 6,190,077 | B1 | * | 2/2001 | Newson et al. | 401/218 |
| 6,312,180 | B1 | * | 11/2001 | Panda | 401/130 |

FOREIGN PATENT DOCUMENTS

| | | |
|---|---|---|
| DE | 854 169 | 10/1952 |
| DE | 3 121 948 A1 | 12/1982 |
| DE | 196 17 777 A1 | 6/1997 |
| EP | 0 697 294 | 2/1996 |
| EP | 0 747 240 | 12/1996 |
| FR | 710 720 | 5/1930 |
| GB | 2251 429 A | 7/1992 |
| WO | WO 96/14998 | 5/1996 |

* cited by examiner

*Primary Examiner*—David J. Walczak
(74) *Attorney, Agent, or Firm*—Jones Day LLP

(57) ABSTRACT

A hand-held dispenser for applying a flowable correction medium on a substrate surface. The correction medium is provided in a reservoir of the dispenser and in fluid communication with an application member at least during operation of the dispenser, when the dispenser is pressed against a substrate surface, such that the correction medium can flow from the reservoir to the application member. The application member is configured and dimensioned such that an application width of the application member can be selected by adjusting the dimensions of a contact region of the application member and the substrate surface. This can be particularly done by adjusting the force and/or the direction by which the application member is pressed against the substrate surface.

24 Claims, 3 Drawing Sheets

HAND-HELD DISPENSER FOR APPLYING A FLOWABLE CORRECTION MEDIUM ON A SUBSTRATE SURFACE

CROSS-REFERENCE TO RELATED APPLICATIONS

This application is a continuation of the U.S. national stage designation of copending International Patent Application PCT/EP01/01531, filed Feb. 12, 2001, which claims priority to European Application EP 00 103 992.4, filed Feb. 25, 2000, the entire contents of which are expressly incorporated herein by reference thereto.

FIELD OF THE INVENTION

The present invention relates generally to a hand-held dispenser for applying a flowable correction medium on a substrate surface.

BACKGROUND OF THE INVENTION

The application of a correction medium or fluid by means of a pencil or brush is well-known in the art. According to one known technique, a small brush is dipped into the correction fluid in a small container and then the fluid is applied by "painting" the region to be corrected with the small brush. Typically, such a correction medium is a liquid or a gel having particles dispersed therein. Alternatively, the correction medium can be a gas charged with particles or droplets (aerosol) or a flowable solid such as powder.

Another known technique relates to dispensers in which the correction medium is automatically supplied from a reservoir or container to an application member during the use of the dispenser. Such dispensers are therefore characterized by a flow of the correction medium towards the application member during the use of the dispenser.

Pen like dispensers for correction fluids are well-known. For example U.S. Pat. No. 4,685,820 to Kremer et al. discloses an applicator device for applying a liquid or a flowable solid to a surface. The device comprises a material container and a surface applicator for applying the applicator material to the surface. A valve having a valve element is interposed between the material container and the surface applicator to permit the flow of applicator material to the surface applicator when the valve element is in an open position and to inhibit the flow of applicator material to the surface applicator when the valve element is in a closed position. The surface applicator comprises the distal end portion of the valve element co-operating with the applicator opening when the distal end portion of the valve element is pressed against the surface, thereby forming an annular opening for the flow of the applicator material to apply and disperse the applicator material on the surface. Such an applicator device is suitable for applying liquids such as type writer correction fluids, oils, pains and coatings as well as semi-solids or solids such as glues, gels and powders.

U.S. Pat. No. 4,813,463 to Lin discloses an instantly applicable correction fluid container structure. The device comprises a threaded cap which can semi-automatically dispense the contents via a port on the top of the cap by pressing down the upper conical portion of a spring-biased mounted control portion therein.

U.S. Pat. No. 5,123,766 to Babiak discloses a correction fluid dispensing pen including a cylindrical body formed with a conically tapered forward end, with the forward end including a spherical or brush applicator. The cylindrical body includes an end cap threadedly mounted thereon, with the end cap housing a piston. The piston is biased within the cylindrical body to effect pressurizing of a fluid reservoir contained within the cylindrical body to direct such fluid through the applicator brush or spherical member of the applicator.

U.S. Pat. No. 5,261,755 to Draper et al. discloses a fluid dispenser for depositing a liquid correction fluid onto a print medium, wherein the dispenser is formed of an elongated tubular body having a valve means at one end and being closed at the opposite end for retaining the fluid therein. The tubular body is substantially circular in cross-section at either end and comprises an enlarged body portion of larger cross-section for squeezing the material from the body when the valve is in the open position.

U.S. Pat. No. 5,499,881 to Chang discloses a writing implement with correction supply. U.S. Pat. No. 5,516,223 to Matz et al. discloses a correction fluid including a suspending agent, a binding resin, water and an opacifying pigment. U.S. Pat. No. 4,511,273 to Trotta discloses a correction fluid dispenser having a retractable and lockable sealing tip.

U.S. Pat. No. 4,917,521 to Lai discloses a pen type container for correction fluid with daubing function. A manually-squeezable lever is mounted on the container for rotating the cover. A wedge surface on the cover interior surface is slidably engaged with the wedge surface on the spiral liner wall, such that rotation of the cover causes the spiral liner to move the internal shaft away from the liquid discharge opening at the tip end of the cover.

U.S. Pat. No. 5,971,648 to Koreska discloses a pen for applying a color or correction liquid. U.S. Pat. No. 5,482,393 to Sekiguchi et al. discloses a dispenser for applying correction liquid to writing errors that includes a valving rotary ball which controls the dispensing. The rotary ball is normally biased against a spring member via an elongated biasing element to shut-off dispensing of the correction liquid. To insure integrity of shut-off and dispensing of correction liquid, the biasing member is a cylindrical member which has been integrally been formed at the end distant from the rotary ball to provide an outwardly extending stepped portion which firmly engages with the biasing spring.

U.S. Pat. No. 5,056,949 to Petrillo discloses a correction fluid dispenser with a ball valve comprising a body member adapted to retain a correction fluid and a barrel disposed at one end thereof for delivery of the fluid to a surface. The barrel terminates in an orifice formed by a circular rim with a spherical ball of greater diameter disposed in the barrel at the orifice. The ball is supported by a socket member, the ball and socket member being spring biased toward the orifice. A stop means is provided to prevent the ball from extending entirely within the rim of the orifice.

U.S. Pat. No. 5,716,151 to Satake discloses a coating tool. U.S. Pat. No. 4,572,691 to Kirchhoff et al. discloses a pen-like instrument for applying correction fluid comprising an elongate housing, a bag of thin flexible polymeric film material containing correction fluid within a cavity in the housing, and an applicator tip assembly. The applicator tip assembly comprises a body secured to the housing and the bag and having a through opening. The correction fluid is dispensed through the through opening when an applicator member positioned within the through opening is separated from a lip on the body against the bias of a spring.

U.S. Pat. No. 4,812,071 to Batra, deceased et al. discloses a correction fluid pen for applying a correction fluid, the correction fluid being of the type containing an opaque covering pigment and a volatile solvent.

U.S. Pat. No. 4,923,317 to Bishop et al. discloses a brushless correction fluid applicator for use in applying correction fluid to paper without using a brush. The correction fluid is a suspension including a substantial proportion of white or substantially white particles, such as titanium dioxide, or other color particles. The applicator includes a wear-resistant, porous tip, and a regulator between the tip and the reservoir. The regulator may be formed of foam material, and the tip may be of sturdy porous plastic. The size of the pores in the tip and regulator are large enough so that they do not become clogged with particles in the correction fluid. The regulator prevents the tip from dripping by regulating the rate at which fluid can leave the reservoir. The size of the pores adjacent the reservoir may be different from the size of the pores and passageways adjacent the tip. The applicator may be provided with an air-tight cap to avoid drying out between uses. Alternative embodiments of the applicator include a foam tip with a nylon mesh outer covering for wear resistance, and an internal, pressure-actuated valve may be included to regulate the flow of the correction fluid to the tip.

In view of the above prior art it, a need exists for an improved hand-held dispenser for applying a flowable correction medium on a substrate surface in a more user-friendly manner.

SUMMARY OF THE INVENTION

The present invention is directed to a hand-held dispenser for applying a flowable correction medium on a substrate surface. The dispenser comprises a reservoir for housing the correction medium, an application member in fluid communication with the reservoir, and an intermediate element interposed between the application member and the reservoir. In the operating state of the dispenser, in which the dispenser is pressed against the substrate surface, the correction medium can flow from the reservoir to the application member. The application member is designed such that the application width of the application member can be selected by the user by adjusting the force and/or by adjusting the direction in/by which the application member is pressed against the substrate surface. By adjusting the force and/or the direction/angle between the application member the dimensions of the contact region between the application member and the substrate surface can be selected.

In one embodiment, the application member is a rotatable element elastically retractable in the longitudinal direction and, during operation of the dispenser, the correction medium can flow from the reservoir to the application member. The intermediate element is configured to transport the correction medium to the application member, and may be a part of a displaceable portion of a valve mechanism for selectively bringing the reservoir into fluid communication with the application member. The user can select the desired application width of the dispenser as is customary with other pen-like devices. This can be done, for instance, by selecting the dimensions of the contact region of the application member and the substrate surface.

In one embodiment, the tip of the application member can be elastically deformable such that the width of at least the tip of the application member increases when the application member is pressed against the substrate surface. Also, the tip of the application member can be elastically retractable.

The correction medium can consist of an aerosol, a liquid, or a gel having particles dispersed therein, or a flowable solid. A valve mechanism can be provided by means of which the container can be selectively brought in communication with the application member. The valve mechanism can comprise an elastic member such that the valve mechanism is in a closed state as long as there is no inwardly directed thrust force acting on the application member. The valve mechanism opens as soon as the inwardly directed thrust force exceeds a predetermined level.

In one embodiment, the cross-section of the front region of the application member can taper towards the tip of the application member. In another embodiment, the application can be made of a porous or pervious material. The application element can comprise at least one channel parallel to its length direction.

In another embodiment, the application member can be a rotatable element such as a substantially/generally toroidal element or a roller. The cross-section of the outer region of the application member can have an asymmetrically pointed shape. In an alternate embodiment, the application member can be made from a rigid material, and the application member can be held by a transverse bearing axis. An intermediate rotatable element can be provided essentially in contact with the application member to transport the correction medium to the application member. The intermediate rotatable element can be part of the displaceable element of the valve mechanism. Also, the correction medium in the reservoir can be pressurized.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE PREFERRED EMBODIMENTS

Figure 1:
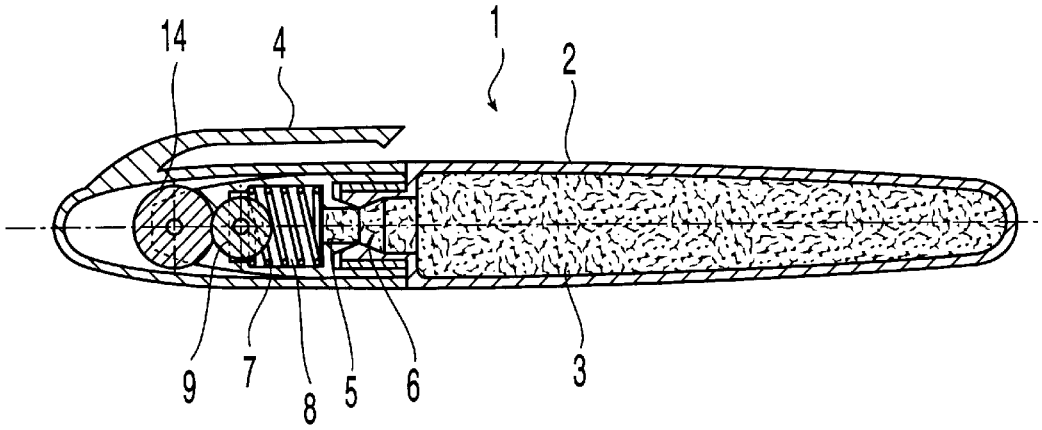
FIG. 1 is an axial cross-sectional view taken from the side of a first embodiment of a device according to the present invention.
Figure 2:
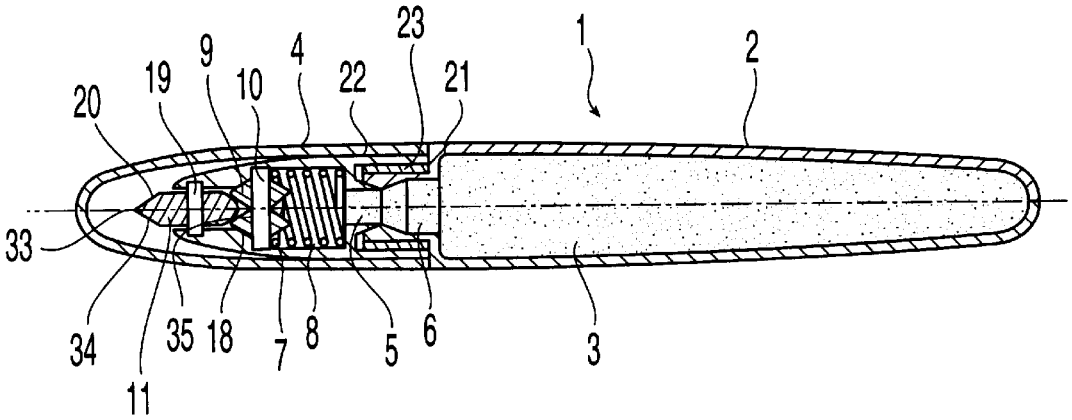
FIG. 2 is an axial cross-sectional view taken from 90° from the view of the device of FIG. 1.

Referring to FIGS. 1 and 2, a first embodiment of the present invention generally comprises a dispenser 1 comprising a housing 2 for a container or reservoir 3 for correction medium. Housing 2 is connected, for example, by means of a screw thread 23, to a main portion 22, wherein main portion 22 comprises an application mechanism for applying the correction medium contained in reservoir 3 on a substrate surface, such as paper. Housing 2 and its screw thread 23 form a cartridge 21.

When dispenser 1 is not in use, an air tight cap 4 can be clamped or screwed on main portion 22 to prevent correction medium still present on the applicator from drying.

The correction medium can be an aerosol, i.e., a gas with solid particles or droplets. Alternatively, the correction medium can be a liquid or a gel having particles dispersed therein. Particularly in case of a liquid or gel, the correction medium can comprise an opaque covering pigment in a volatile solvent. Examples of a liquid or a gel having particles dispersed therein are disclosed in U.S. Pat. No. 5,516,223 to Matz et al. As a further alternative, the correction medium can be a flowable solid such as powder. Also, the correction medium in reservoir 3 can be pressurized to further facilitate the flowing of the correction medium from reservoir 3 to the applicator.

According to the embodiment of FIGS. 1 and 2, the correction medium in reservoir 3 can be brought into communication with the applicator when using dispenser 1, i.e., when the applicator is pressed with a predetermined force against a substrate surface. The communication between reservoir 3 and the applicator, which is an application roller 11 according to this first embodiment, can be established by means of a tapered passage 6, a further passage 5 with reduced diameter and a spring compartment 8. A spiral spring 7 is provided within spring compartment 8. In use, when applicator roller 11 is pressed against a substrate surface, application roller 11 is slightly displaced backwardly, due to a displaceable bearing axis 19 and application roller 11 displaces an intermediate roller 9 against the spring-biasing force of spiral spring 7. Intermediate roller 9 preferably includes a tapered cross-section that forms a valve mechanism together with a conical seat 18 having a matching diameter to the cross-section of intermediate roller 9. Intermediate roller 9 is provided with a congruent notch 35 being engaged with the tapered circumferential portion of applicator roller 11.

Therefore, when intermediate roller 9 is displaced backwardly against the spring-biasing force of spring 7, the valve formed by intermediate roller 9 and conical seat 18 formed within main portion 22 opens. The correction medium can thus freely flow from reservoir 3 to intermediate roller 9 by means of which the correction medium is applied on the outer circumference 20 of application roller 11. It should be noted that the cross-section of outer region 20 of application roller 11 is tapered. Due to this fact and furthermore that at least the circumference portion of application roller 11 is made of an elastic material, the contact region between the application element (application roller) 11 and a substrate surface can be adjusted by the force and/or the angle by which dispenser 1 and particularly application roller 11 is pressed against the substrate surface. These features are advantageous in comparison to prior art devices employing ball-like applicators made of a hard material, such as steel, as the contact region between the ball and the substrate surface cannot be changed by changing the force and/or the application angle.

According to the present invention, the application width of dispenser 1 can be changed by changing the contact region of the tip of the applicator with the substrate surface either by means of changing the application force (pressure) or the application angle. In embodiments wherein at least the tip portion of the applicator (i.e., the outer circumferential portion of a rotatable applicator) is made of an elastically deformable material, the width of at least the tip of the application member increases when the application member is pressed against the substrate surface. In embodiments wherein the tip (or the circumferential portion in cross-section) is tapered, by changing the application angle selectively, the pointed tip 33 or the beveled edges 34 can be brought into contact with the substrate surface. If the pointed tip 33 is brought into contact with a substrate, the application width can be quite small. If the beveled edges 34 of the applicator is brought into contact with the substrate surface, the application width can be larger due to the enlarged contact region between the applicator and the substrate surface.

Figure 3:
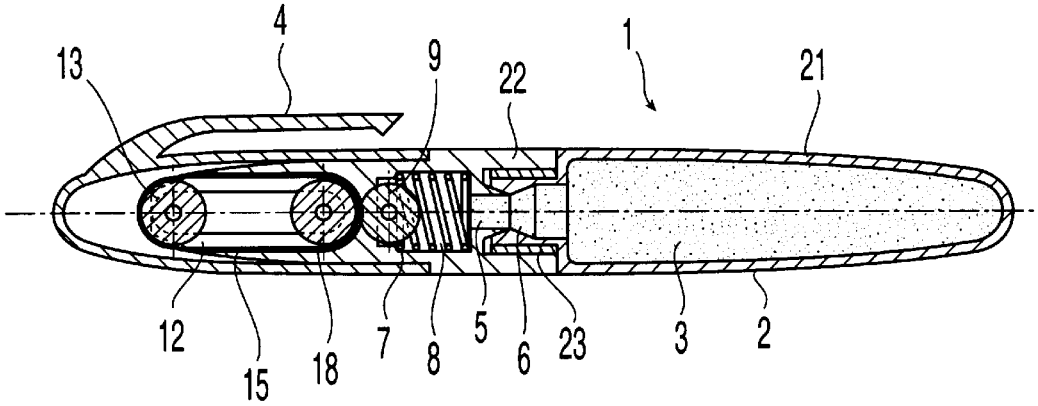
FIG. 3 is an axial cross-sectional view taken from the side of a second embodiment of a device according to the present invention.
Figure 4:
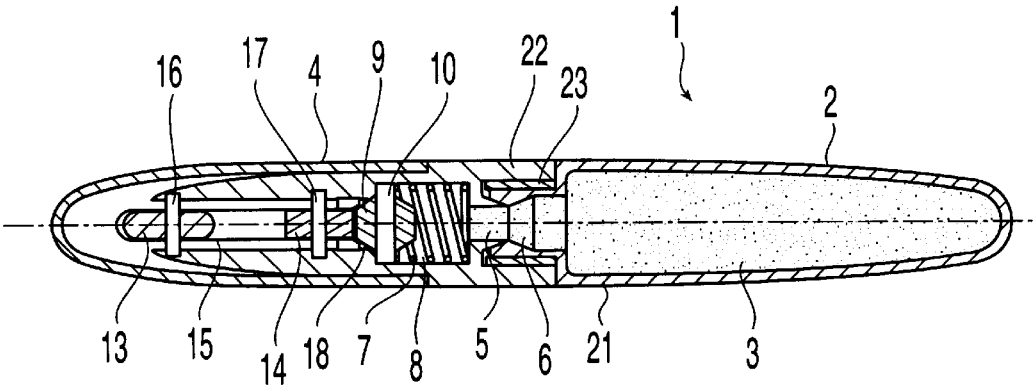
FIG. 4 is an axial cross-sectional view taken from 90° from the view of FIG. 3.

Referring to FIGS. 3 and 4, a second embodiment of the present invention is shown which is similar to the first embodiment, except the single application roller 11 replaced by an application conveyer 12. Application conveyor 12 comprises a front roller 13, a rear roller 14, and a conveyer belt 15. The bearing axis 16 of front roller 13 and bearing axis 17 of rear roller 14 are fixed in position relative to each other, such that when front roller 13 is pressed against a substrate surface and thus displaced slightly rearwardly (due to the fact that the bearing axis 16 is also slightly displaceable), bearing axis 17 is similarly displaced and thus rear roller 14 of conveyer applicator 12 will also be displaced rearwardly and will activate the valve mechanism formed by conical seat 18 and intermediate roller 9 with its displaceable bearing axis 10. Also in this embodiment, preferably at least the outer circumference of front roller 13 is tapered or round and conveyer belt 15 is configured to be in close contact with the tapered or round outer circumference of front roller 13.

Figure 5:
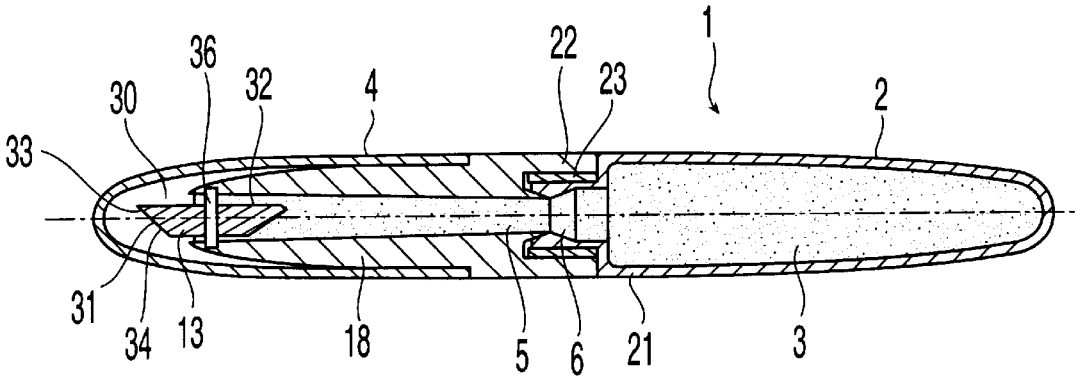
FIG. 5 is an axial cross-sectional view taken from the side of a third embodiment of a device according to the present invention.

Referring to FIG. 5, a third embodiment of the present invention is shown. The embodiment of FIG. 5 includes a substantially/generally toroidal applicator 30 and differs from the embodiment of FIGS. 1 and 2 in that there is no valve mechanism and no intermediate roller 9. The cross-section 31 of the outer region of substantially/generally toroidal applicator 30 has an asymmetrically pointed shape, as is known for example in the marker pen art. In this embodiment, for example, the whole substantially/generally toroidal applicator 30 can be made of an inelastic and rigid material. According to this embodiment, the application width can be changed by changing the application angle, i.e., selectively contacting the substrate surface only with the asymmetric pointed tip 33 or the beveled edge 34 of the substantially/generally toroidal applicator 30. Although not shown in FIG. 5, a valve mechanism and/or intermediate rotating element (as in the embodiments of FIGS. 1–4) can also be provided. The embodiments of FIGS. 1 to 5 all have an applicator that is a rotating element with a displaceable bearing axis 16, 17, 19 (FIGS. 1–4) or a non-displaceable bearing axis 36 (FIG. 5).

Figure 6:
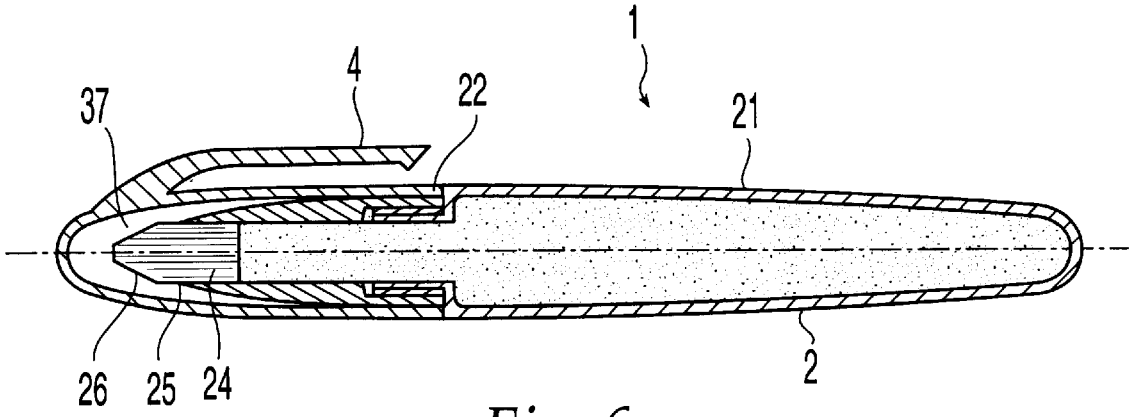
FIG. 6 is an axial cross-sectional view taken from the side of a fourth embodiment a device according to the present invention.
Figure 7:
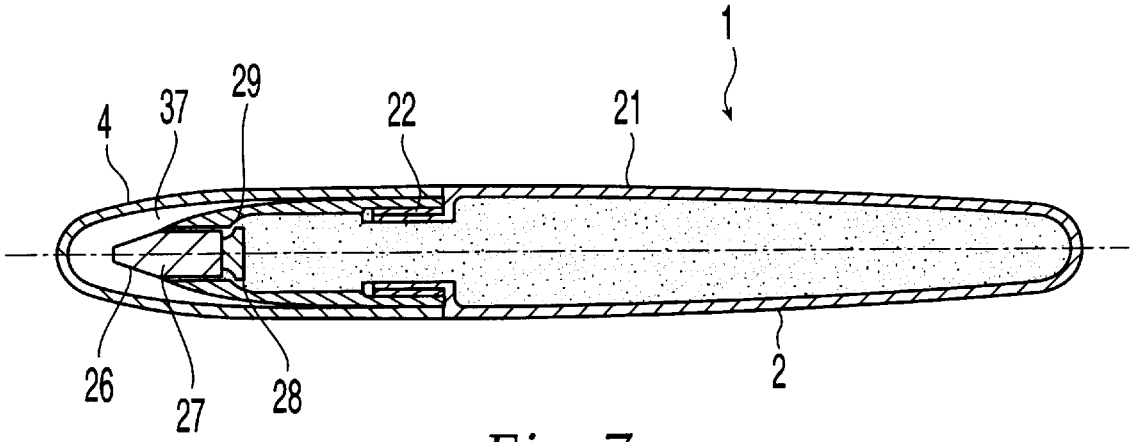
FIG. 7 is an axial cross-sectional view taken from 90° from the view of the device of FIG. 6.

Referring to FIGS. 6 and 7, another embodiment is shown wherein the applicator is a non-rotatable element 37 made for example of furred material. The non-rotatable applicator 37 is either made as a pervious applicator 24 (FIG. 6) or a porous applicator 27 (FIG. 7). In the case of pervious applicator member 24, as shown in FIG. 6, longitudinal channels 25 can be provided in the longitudinal direction of applicator 24. Also, pervious channel applicator 24 is provided with a tapered tip 26. Also, according to the embodiment of FIGS. 6 and 7, a valve mechanism, similar to that shown in embodiments of FIGS. 1 to 4, can be provided.

FIG. 7 shows a slight modification of the embodiment of FIG. 6 in that channel applicator 24 is replaced by a porous applicator 27. The size of the pores of porous applicator 27 is set such that the pores are not clogged by the correction medium and particularly by any solid particles dispersed in the correction medium provided in reservoir 3. The rear end of porous applicator 27 is provided with a valve element 28 co-operating with a conical seat 29 to form a valve mechanism. When porous applicator 27 is pressed against a substrate surface, the applicator is slightly displaced rearwardly to open the valve mechanism formed by conical seat 29 and valve element 28 attached to applicator 27. Furthermore, due to the elastic nature of porous applicator 27, the tapered tip 26 will increase in the width direction depending on the pressure exerted on dispenser 1 and thus on applicator 27.

List of References

| | |
|---|---|
| 1 | dispenser |
| 2 | housing |
| 3 | reservoir for correction particles dispersed in flowable medium |
| 4 | cap |
| 5 | passage |
| 6 | tapered passage |
| 7 | spring |
| 8 | spring compartment |
| 9 | intermediate roller |
| 10 | bearing axis of 9 (displaceable against spring 7) |
| 11 | application roller |
| 12 | application conveyer |
| 14 | front roller of 12 |
| 15 | conveyer belt |
| 16 | bearing axis of 13 |
| 17 | bearing axis of 14 |
| 18 | conical seat |
| 19 | bearing axis of 11 |
| 20 | tapered outer surface of 11 |
| 21 | screwed cartridge portion |
| 22 | main portion |
| 23 | screw thread |
| 24 | pervious application member |
| 25 | longitudinal channels |
| 26 | tapered tip of 24 |
| 27 | porous applicator |
| 28 | valve |
| 29 | conical seat |
| 30 | inelastic substanitally/generally toroidal applicator |
| 31 | pointed circumference of 30 |
| 32 | sealing |
| 33 | pointed tip |
| 34 | beveled edge |
| 35 | congruent notch of 9 |
| 36 | non-displaceable bearing axis of 30 |
| 37 | non-rotatable applicator |

What is claimed is:

1. A dispenser for applying a flowable medium on a substrate surface, said dispenser comprising:

a reservoir for flowable medium extending along a longitudinal axis;

an application member in fluid communication with said reservoir, such that during operation of said dispenser flowable medium can flow from said reservoir to said application member, wherein said application member is a rotatable element elastically retractable in the longitudinal direction; and an intermediate rotatable element mounted on a bearing axis interposed between said application member and said reservoir and configured to transport flowable medium to said application member, wherein said intermediate rotatable element is displaceable to selectively bring said reservoir into fluid communication with said application number.

2. The dispenser according to claim 1, wherein said application member is configured and dimensioned such that an application width of said application member can be selected by adjusting the force and/or the direction by which said application member is pressed against the substrate surface.

3. The dispenser according to claim 2, wherein said application member has an elastically deformable tip such that a width of at least said tip increases when the application member is pressed against the substrate surface.

4. The dispenser according to claim 1, further including flowable medium comprising an aerosol, a liquid or gel having particles dispersed therein, or a flowable solid.

5. The dispenser according to claim 1, further comprising a valve mechanism which can selectively bring said reservoir into fluid communication with said application member, wherein said intermediate rotatable element is a part of a displaceable portion of said valve mechanism.

6. The dispenser according to claim 5, wherein said valve mechanism comprises an elastic member such that said valve mechanism is movable from a closed position when there is no inwardly directed thrust force acting on said application member and an open position when inwardly directed thrust force exceeds a predetermined level.

7. The dispenser according to claim 1, wherein a cross section of a front region of said application member tapers towards a tip of said application member.

8. The dispenser according to claim 1, wherein said application member is made of a porous or pervious material.

9. The dispenser according to claim 1, wherein said application member has a substantially toroidal shape.

10. The dispenser according to claim 1, wherein said application member is held by a transverse bearing axis.

11. The dispenser according to claim 1, wherein the outer region of said application member has a cross section having an asymmetrically pointed shape.

12. The dispenser according to claim 11, said application member is made from a rigid material.

13. The dispenser according to claim 1, further comprising pressurized correction medium in said reservoir.

14. The dispenser according to claim 1, wherein said intermediate rotatable element is provided essentially in contact with said application member to transport correction medium to said application member.

15. A dispenser for applying a flowable medium on a substrate surface, said dispenser comprising:

a reservoir containing pressurized correction medium; and a rotatable application member in fluid communication with said reservoir, such that during operation of said dispenser flowable medium can flow from said reservoir to said application member for application to a substrate surface;

wherein said application member is rotatable about a bearing axis and has an outer region with a tapered cross-section.

16. The dispenser according to claim 15, wherein said application member has an elastically deformable tip such that a width of at least said tip increases when the application member is pressed against the substrate surface.

17. The dispenser according to claim 15, wherein the flowable medium comprises an aerosol, a liquid or gel having particles dispersed therein, or a flowable solid.

18. The dispenser according to claim 15, further comprising a valve mechanism which can selectively bring said reservoir into fluid communication with said application member.

19. The dispenser according to claim 18, wherein said valve mechanism comprises an elastic member such that said valve mechanism is movable from a closed position when there is no inwardly directed thrust force acting on said application member and an open position when inwardly directed thrust force exceeds a predetermined level.

20. The dispenser according to claim 15, wherein said application member is made of a porous or pervious material.

21. The dispenser according to claim 15, wherein said application member has a substantially toroidal shape.

22. The dispenser according to claim 15, wherein said bearing axis is a transverse bearing axis.

23. The dispenser according to claim 15, wherein the outer region of said application member has a cross section having an asymmetrically pointed shape.

24. The dispenser according to claim 15, wherein said application member is made from a rigid material.

* * * * *